US009003861B2

(12) United States Patent
Martin et al.

(10) Patent No.: US 9,003,861 B2
(45) Date of Patent: Apr. 14, 2015

(54) AUTO-CALIBRATION SYSTEMS FOR COIN COUNTING DEVICES

(75) Inventors: Douglas A. Martin, Woodinville, WA (US); Michael A. Stoy, Bothell, WA (US)

(73) Assignee: Outerwall Inc., Bellevue, WA (US)

( * ) Notice: Subject to any disclaimer, the term of this patent is extended or adjusted under 35 U.S.C. 154(b) by 361 days.

(21) Appl. No.: 13/269,121

(22) Filed: Oct. 7, 2011

(65) Prior Publication Data

US 2013/0086973 A1 Apr. 11, 2013

(51) Int. Cl.
*G07D 5/00* (2006.01)

(52) U.S. Cl.
CPC ..... *G07D 5/00* (2013.01); *G07D 2205/0012* (2013.01)

(58) Field of Classification Search
CPC ..... G07D 5/08; G07D 2205/0012
USPC ..... 73/163, 514.14
See application file for complete search history.

(56) References Cited

U.S. PATENT DOCUMENTS

| | | | | |
|---|---|---|---|---|
| 4,437,558 | A * | 3/1984 | Nicholson et al. | 194/325 |
| 4,963,118 | A * | 10/1990 | Gunn et al. | 453/3 |
| 5,067,604 | A * | 11/1991 | Metcalf | 194/203 |
| 5,992,602 | A * | 11/1999 | Zwieg et al. | 194/317 |
| 6,311,820 | B1 * | 11/2001 | Hallas Bell et al. | 194/317 |
| 7,131,580 | B2 | 11/2006 | Molbak | |
| 7,213,697 | B2 | 5/2007 | Martin et al. | |
| 7,520,374 | B2 | 4/2009 | Martin et al. | |
| 7,865,432 | B2 | 1/2011 | Doran et al. | |
| 7,874,478 | B2 | 1/2011 | Molbak | |
| 2004/0055359 | A1 * | 3/2004 | Ketler et al. | 73/1.07 |
| 2004/0129527 | A1 * | 7/2004 | Jonsson | 194/320 |
| 2009/0259424 | A1 * | 10/2009 | Dutta et al. | 702/85 |
| 2010/0207991 | A1 * | 8/2010 | Koizumi | 347/32 |

FOREIGN PATENT DOCUMENTS

KR 10-2007-0106819 11/2007

OTHER PUBLICATIONS

International Search Report and Written Opinion for PCT Application No. PCT/US2012/058730, Mail Date Mar. 28, 2013, 11 pages.

* cited by examiner

*Primary Examiner* — Laura Martin
*Assistant Examiner* — Irving A Campbell
(74) *Attorney, Agent, or Firm* — Perkins Coie LLP

(57) ABSTRACT

Systems and methods for calibrating a coin sensor are disclosed herein. An auto-calibrating coin sensor configured in accordance with one embodiment of the disclosure includes a movable carrier holding at least one test coin or other test object. The carrier can move the test object past or through the coin sensor to calibrate the coin sensor. Embodiments of the present technology can include rotatable and linearly moveable carriers that are configured to move an attached test object through a coin sensor. Additionally, auto-calibrating coin sensors in accordance with the present technology can be configured to initiate an auto-calibration based on the commencement of a coin counting session, a set schedule, a temperature change, and/or other events.

25 Claims, 7 Drawing Sheets

AUTO-CALIBRATION SYSTEMS FOR COIN COUNTING DEVICES

CROSS REFERENCE TO APPLICATIONS INCORPORATED BY REFERENCE

The subject matter of the following U.S. patents are incorporated into the present application in their entireties by reference: U.S. Pat. Nos. 7,520,374, 7,865,432, and 7,874,478.

TECHNICAL FIELD

The following disclosure relates generally to auto-calibration systems, and more specifically to systems for automatically calibrating a coin counting device.

BACKGROUND

A number of coin counting devices include sensors to discriminate coin denominations, discriminate coins from different countries, and/or discriminate coins from non-coin objects. These devices can include coin counters, gaming devices such as slot machines, vending machines, bus or subway "fare boxes," etc. In such devices, accurate discrimination of deposited coins is important for economical operation of the device.

Some coin handling devices include electromagnetic sensors to discriminate deposited objects. Generally, these sensors generate an electromagnetic field that interacts with the object. The interactions are analyzed to determine whether the object is a coin, and if so, which denomination it is. Although these sensors can be extremely accurate, slight disparities in performance arise due to variations within the tolerances of fabrication that are inherent in the manufacturing process. These disparities can often be corrected for by calibrating the sensor prior to placing the device in service. However, the performance of the sensor can also be affected by ambient temperature variations in the operating environment. These temperature variations often necessitate manual calibrations of the sensor in order to maintain the highly accurate performance that is required of the device. Hence, conventional sensors often require periodic maintenance visits by technicians that increase the cost of operating these devices.

DETAILED DESCRIPTION

The following disclosure describes various embodiments of automatic calibration systems for use with coin sensors, and associated methods of manufacture and use. Certain details are set forth in the following description and FIGS. 1A-6 to provide a thorough understanding of various embodiments of the disclosure. Other details describing well-known structures and systems often associated with calibration systems, coin counting machines and electromagnetic sensors, however, are not set forth below to avoid unnecessarily obscuring the description of the various embodiments of the disclosure.

Many of the details and features shown in the Figures are merely illustrative of particular embodiments of the disclosure. Accordingly, other embodiments can have other details and features without departing from the spirit and scope of the present disclosure. In addition, those of ordinary skill in the art will understand that further embodiments can be practiced without several of the details described below. Furthermore, various embodiments of the disclosure can include structures other than those illustrated in the Figures and are expressly not limited to the structures shown in the Figures. Moreover, the various elements and features illustrated in the Figures may not be drawn to scale.

In the Figures, identical reference numbers identify identical, or at least generally similar, elements. To facilitate the discussion of any particular element, the most significant digit or digits of any reference number refer to the Figure in which that element is first introduced. Element 102, for example, is first introduced and discussed with reference to FIG. 1A.

Figure 1A:
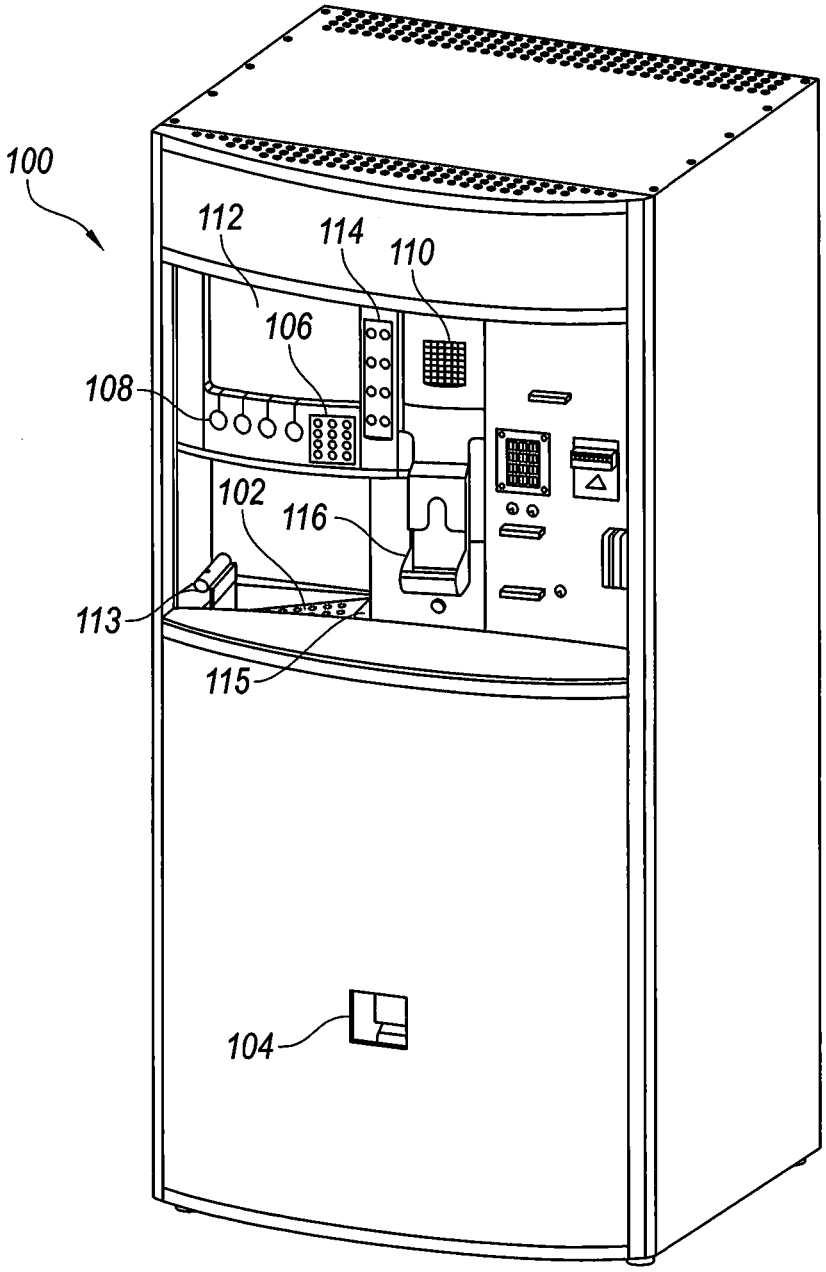
FIG. 1A is an isometric view of a coin counting machine configured in accordance with an embodiment of the present disclosure.

FIG. 1A is an isometric view of a coin counting machine 100 configured in accordance with an embodiment of the present disclosure. In the illustrated embodiment, the coin counting machine 100 includes a coin input region or tray 102 and a coin return 104. The tray 102 includes a handle 113 and an output edge 115. The machine 100 further includes various user-interface devices, such as a keypad 106, user selection buttons 108, a speaker 110, a display screen 112, a touch screen 114, and a voucher outlet 116. In other embodiments, the machine 100 can have other features in other arrangements including, for example, a card reader, a card dispenser, etc. Additionally, the machine 100 can include various indicia, signs, displays, advertisements and the like on its external surfaces. The machine 100 and various portions, aspects and features thereof can be at least generally similar in structure and function to one or more of the machines described in U.S. Pat. Nos. 7,520,374, 7,865,432, and/or 7,874,478, each of which are incorporated herein by reference in their entirety.

Figure 1B:
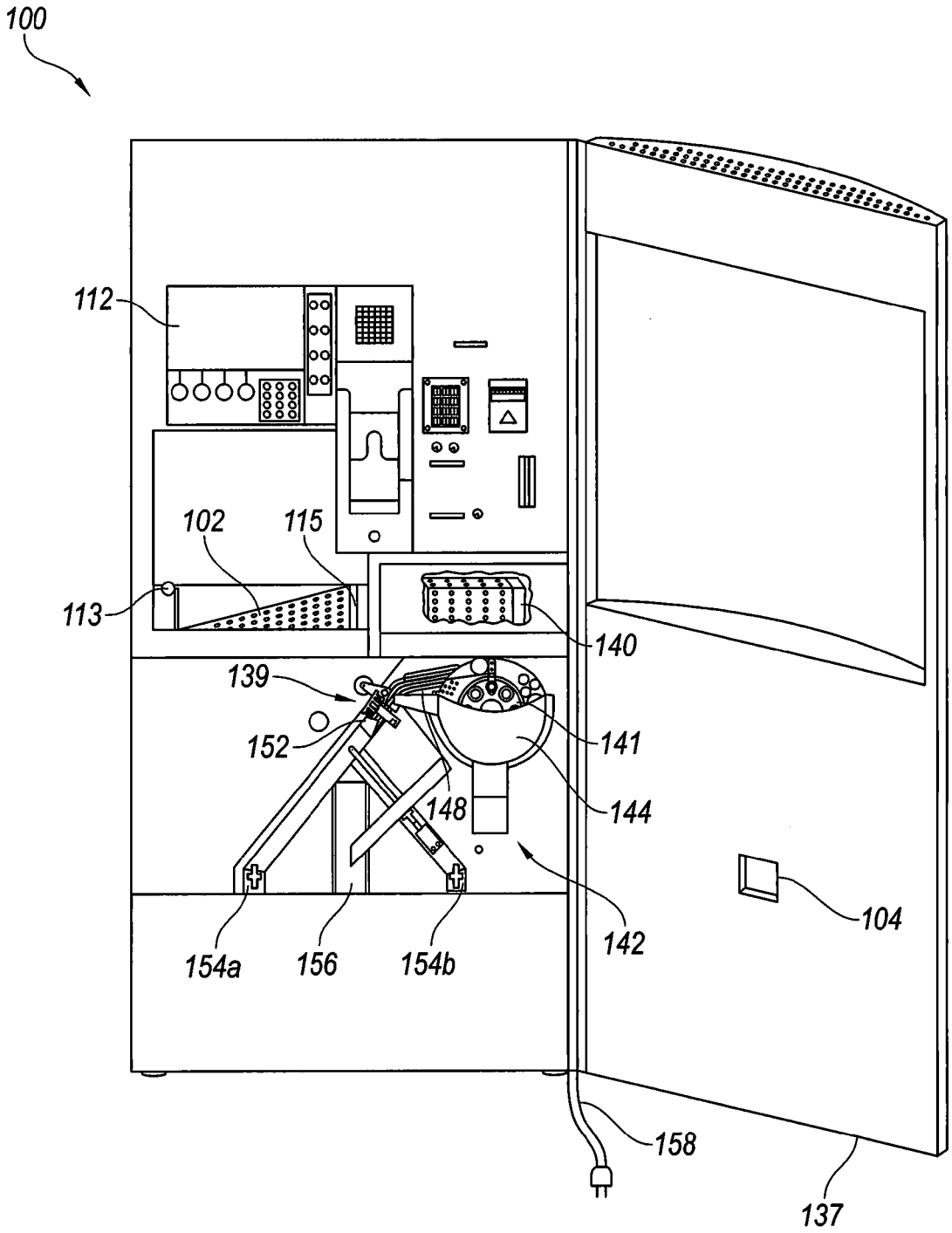
FIG. 1B is a partially cutaway, perspective view of an interior of a coin counting machine having an auto-calibrating sensor assembly configured in accordance with an embodiment of the present disclosure.

FIG. 1B is a partially cutaway, perspective view of an interior portion of the machine 100 having an auto-calibrating sensor assembly 139 configured in accordance with an embodiment of the present disclosure. For ease of reference, the auto-calibrating sensor assembly 139 may alternatively be referred to herein as the sensor assembly 139. The machine 100 includes a door 137 that can rotate to an open position as shown. In the open position, most or all of the components of the machine 100 are accessible for cleaning and/or maintenance. In the illustrated embodiment, the machine 100 includes a coin cleaning portion (e.g., a trommel 140) and a coin counting portion 142. As will be described in more detail below, coins that are deposited into the tray 102 are directed through the trommel 140, and then to the coin counting portion 142. The coin counting portion 142 can include a coin rail 148 that receives coins from a coin hopper 144 via a coin pickup assembly 141. The auto-calibrating sensor assembly 139 is positioned adjacent the coin rail 148 upstream of a diverting door 152, a first coin tube 154*a*, a second coin tube 154*b*, and a coin return chute 156. A power cord 158 can provide power to the machine 100. The components of the coin counting portion 142 can be at least generally similar in structure and function to components described in U.S. Pat. No. 7,520,374.

In operation, the user places a batch of coins, typically of a plurality of denominations (and potentially accompanied by dirt or other non-coin objects and/or foreign or otherwise non-acceptable coins) in the input tray 102. The user is prompted by instructions on the display screen 112 to push a button indicating that the user wishes to have the batch of coins discriminated. An input gate (not shown) opens and a signal prompts the user to begin feeding coins into the machine by lifting or pivoting the tray 102 by handle 113, and/or manually feeding coins over the output edge 115. Instructions on the screen 112 may be used to tell the user to continue or discontinue feeding coins, can relay the status of the machine 100, the amount counted thus far, and/or provide encouragement, advertising, or other messages.

One or more chutes (not shown) direct the deposited coins and/or foreign objects from the tray 102 to the trommel 140. The trommel 140 in the depicted embodiment is a rotatably mounted container having a perforated-wall. A motor (not shown) rotates the trommel 140 about its longitudinal axis. As the trommel rotates, one or more vanes protruding into the interior of the trommel 140 assist in moving the coins in a direction towards an output region. An output chute (not shown) directs the (at least partially) cleaned coins exiting the trommel 140 toward the coin hopper 144.

Figure 2:
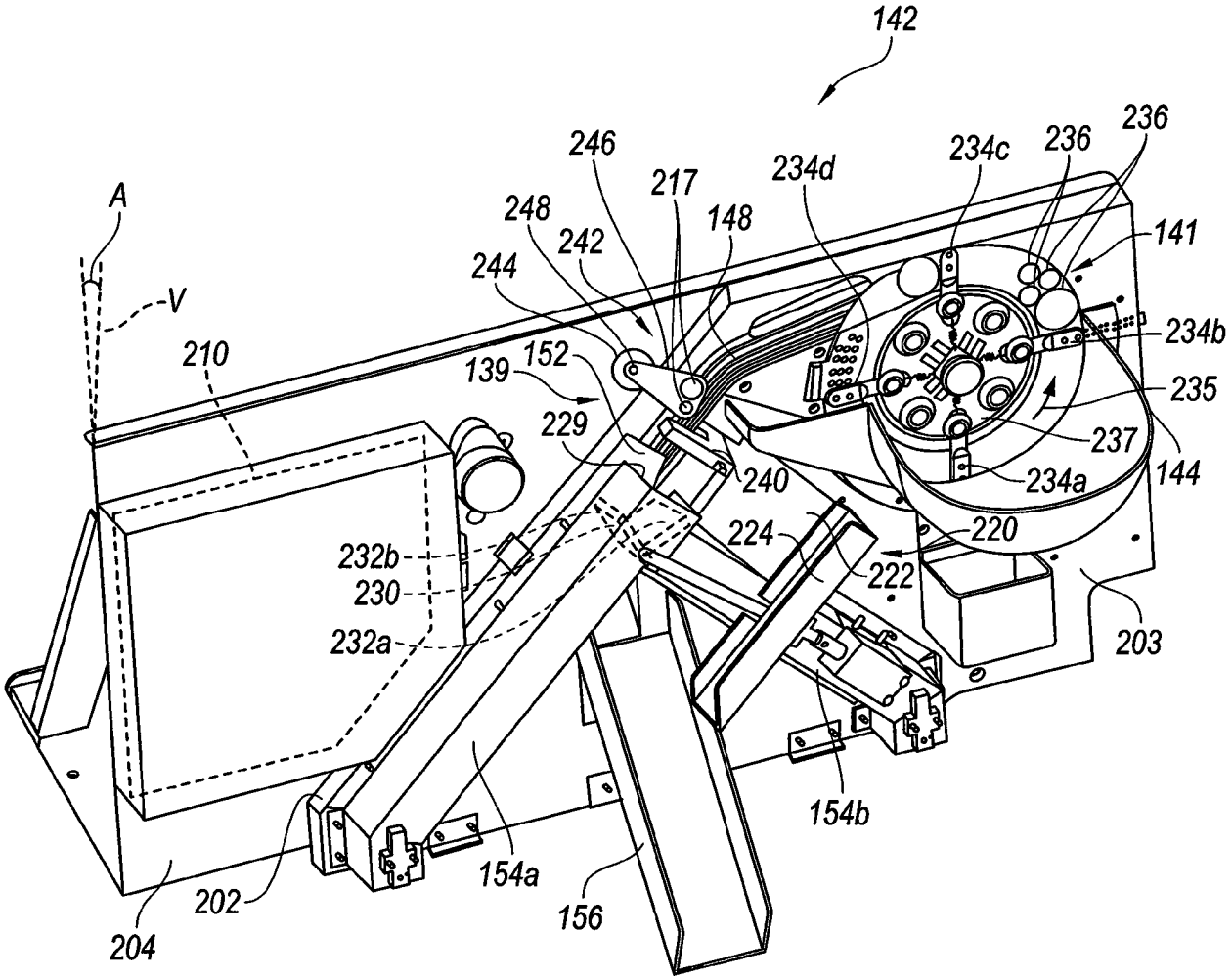
FIG. 2 is a perspective view of a coin counting portion of a coin counting machine configured in accordance with an embodiment of the present disclosure.

FIG. 2 is an enlarged perspective view of the coin counting portion 142 of FIG. 1B illustrating certain features in more detail. In addition to the previously mentioned components, the coin counting portion 142 includes a base plate 202 mounted on a chassis 204. The base plate 202 can be disposed at an angle A with respect to a vertical line V of from about 0° to about 15°. The angle A encourages coins in the hopper 144 to lay flat, such that the face of a given coin is generally parallel with a surface 203 of the base plate 202. A circuit board 210 for controlling operation of various coin counting components can be mounted on the chassis 204.

The illustrated embodiment further includes a rotating disk 237 disposed in the hopper 144, and having a plurality of paddles 234*a*-234*d*. The coin rail 148 extends outwardly from the disk 237, past the sensor assembly 139, and toward a chute inlet 229. A bypass chute 220 includes a deflector plane 222 proximate the sensor assembly 139 and configured to deliver oversized coins to the return chute 156. The diverting door 152 is disposed proximate the chute entrance 229 and is configured to selectively direct discriminated coins toward the coin tubes 154. A flapper 230 is operable between a first position 232*a* and a second position 232*b* to selectively direct coins to the first delivery tube 154*a* or the second delivery tube 154*b*, respectively.

The auto-calibrating sensor assembly 139 includes a coin sensor 240 and a calibration unit 242. In the illustrated embodiment, the calibration unit 242 includes a movable carrier 246 that is operably coupled to a motor 244 by a shaft 248. The carrier 246 can carry one or more calibration objects 217 (e.g., calibrated test objects or coins) that can be moved past the coin sensor 240 to calibrate the sensor, as described in further detail below. In some embodiments, the carrier 246 can be constructed from a non-magnetic and/or non-conductive material. For example, the carrier 246 can be cast, pressed, or otherwise constructed with plastic.

In operation of the coin counting portion 142, the rotating disk 237 rotates in the direction of arrow 235, causing the paddles 234 to lift the coins 236 from the hopper 144 and place them on the rail 148. The coins 236 travel along the rail 148 to the coin sensor 240. Coins that are larger than a preselected size parameter (e.g., a certain diameter) are directed to the deflector plane 222, into a trough 224, and then to the return chute 156. Coins within the acceptable size parameters pass through the coin sensor 240, and the coin sensor 240 and associated software determine if the coin is one of a group of acceptable coins and, if so, the coin denomination is counted. This process can include, for example, the coin sensor 240 producing a magnetic field and measuring changes in inductance as a coin passes through the magnetic field. The changes in inductance can relate to properties of the coin and/or can indicate that a coin has entered or exited the coin sensor 240. The coin counting portion 142, the coin sensor 240, and the denomination determination can be substantially similar in structure and function to the corresponding systems and methods of U.S. Pat. No. 7,520,374, which, as noted above, is incorporated herein in its entirety by reference. Such systems can be found in, for example, various coin-counting kiosks operated by CoinStar, Inc. of 1800 114th Avenue SE, Bellevue, Wash. 98004.

The majority of undesirable foreign objects (dirt, slugs, etc.) are separated from the coin counting process by the trommel 140 or the deflector plane 222. However, coins or foreign objects of similar characteristics to desired coins are not separated by the trommel 140 or the deflector plane 222, and pass through the coin sensor 240. The coin sensor 240 and the diverting door 152 operate to prevent unacceptable coins (e.g., foreign coins), blanks, or other similar objects from entering the coin tubes 154 and being kept in the machine 100. Specifically, in the illustrated embodiment, the coin sensor 240 determines if an object passing through the sensor is a desired coin, and if so, the coin is "kicked" by the diverting door 152 toward the chute inlet 229. The flapper 230 is positioned to direct the kicked coin to one of the coin chutes 154. Coins that are not of a desired denomination, or foreign objects, continue past the coin sensor 240 to the return chute 156.

Figure 3:
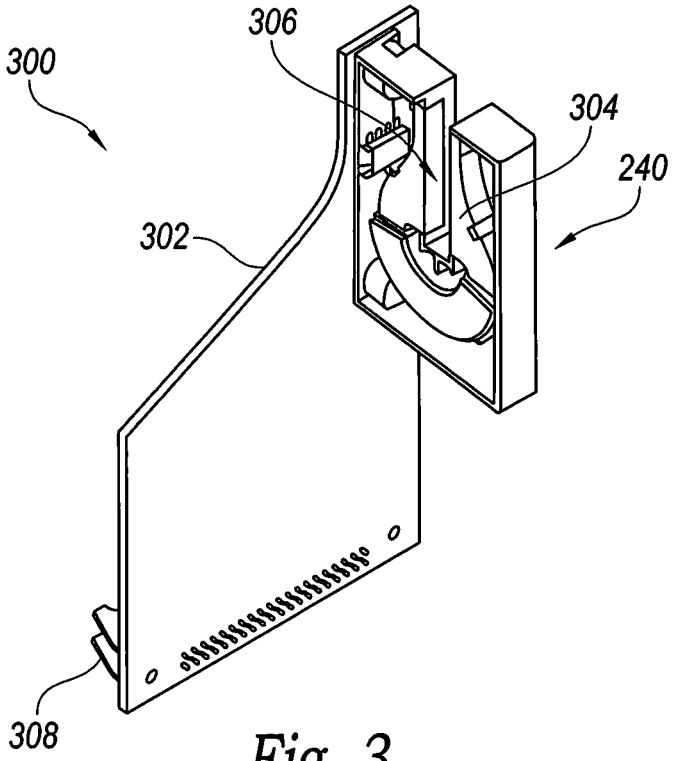
FIG. 3 is an isometric view of a sensor unit including a coin sensor and a printed circuit board configured in accordance with another embodiment of the present disclosure.

FIG. 3 is an isometric view of a sensor unit 300 having the coin sensor 240 operably coupled to a printed circuit board 302 in accordance with an embodiment of the present disclosure. In the illustrated embodiment, the coin sensor 240 includes a generally U-shaped core 304 defining a gap 306. When the sensor unit 300 is installed in the machine 100, the coin rail 148 passes through the gap 306. The sensor unit 300 can be easily installed and/or removed from the coin counting portion 142 via an electrical connector 308 on the printed circuit board 302 and a corresponding receiver (not shown) on the machine 100. Although the illustrated embodiment includes the U-shaped core 304, other embodiments may include a core having a single surface that faces the coin rail 148, or multiple surfaces that face the coin rail 148 from a common side of the coin rail 148.

Figure 4:
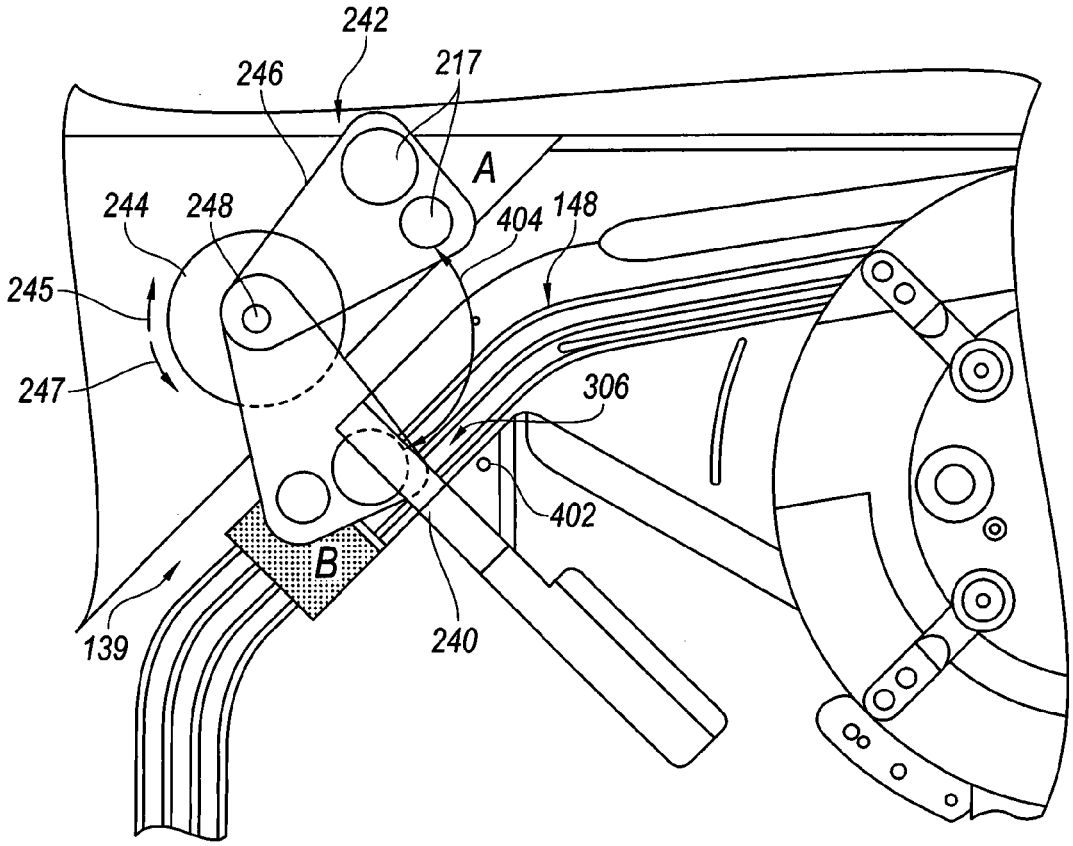
FIG. 4 is a front view of an auto-calibrating sensor assembly configured in accordance with an embodiment of the present disclosure.

FIG. 4 is a front view of the auto-calibrating sensor assembly 139 configured in accordance with an embodiment of the present disclosure. In addition to the previously discussed coin sensor 240 and the calibration unit 242, the illustrated embodiment includes a temperature sensor 402 (shown schematically). The temperature sensor 402 can be a resistive thermal device (RTD), a thermocouple, a thermistor or another temperature sensitive device. In the illustrated embodiment, the temperature sensor 402 can be operably coupled to control circuitry that initiates an automatic calibration when the ambient temperature reaches a preselected value and/or upon a preselected change in ambient temperature.

In operation, the movable carrier 246 is initially stored in position A adjacent the rail 148 but clear of the path that deposited coins travel along the rail 148. Upon initiation of an automatic calibration, the motor 244 rotates the shaft 248 in a first direction 245 to move the carrier 246 from position A to position B. Rotation of the carrier 246 causes the calibration objects 217 to travel along an arcuate path 404 through the gap 306 in the coin sensor 240. The coin sensor 240 generates signals associated with the calibration objects 217, and software (not shown) analyzes and compares the signals to a stored calibration file. If the signals differ from the calibration file by a predetermined amount, the calibration file can be updated. The motor 244 can rotate in a second direction 247 to move the carrier 246 back to position A, before, after, or during comparison of the signal to the calibration file. Alternatively, the motor 244 can continue rotating the carrier 246 in the first direction 245 to return the carrier 246 to position A.

The predetermined difference that results in an update to the calibration file can be established in a number of manners. For example, for any given coin denomination, a shift in the temperature, or other factors affecting the accuracy of the coin sensor 240, can cause the machine 100 to improperly reject valid coins and/or improperly accept invalid coins or other objects. For each desired coin, empirical relationships can be established between improper rejection and acceptance rates and the difference between a stored calibration file and a calibration signal. Based on the relationships between these values, the machine 100 can be configured to update the calibration file at a preferred value that provides the desired operation.

In the illustrated embodiment, at least a portion of the arcuate path 404 of the calibration objects 217 through the coin sensor 240 is substantially similar to the path of deposited coins. Accordingly, the moveable carrier 246 and the attached calibration objects 217 provide for a procedure for passing objects of known or desired properties through the coin sensor 240 in a substantially similar manner to the passage of deposited objects. The similarity of the path 404 to the path of acceptable coins can simplify and improve the accuracy of the calibration procedure. In other embodiments, however, the calibration objects 217 and/or their path may be dissimilar to that of a deposited object, and the differences can be accounted for in software or other features involved in the calibration.

In embodiments of the present disclosure, automatic calibration of the coin sensor 240 can be initiated in a number of different ways. As discussed above, the temperature sensor 402 can be used to initiate an automatic calibration. In other embodiments an automatic calibration will occur as soon as a user interacts with the machine 100 to begin a coin counting operation, and prior to any of the user's coins passing through the sensor 240. In still other embodiments, the machine 100 can be configured to initiate an automatic calibration based on the occurrence of other events. For example, the automatic calibration could be based on a set schedule, such as hourly, daily, etc. Machines configured in accordance with the present disclosure can use any of these and other events alone, or in combination, to initiate an automatic calibration.

Figure 5:
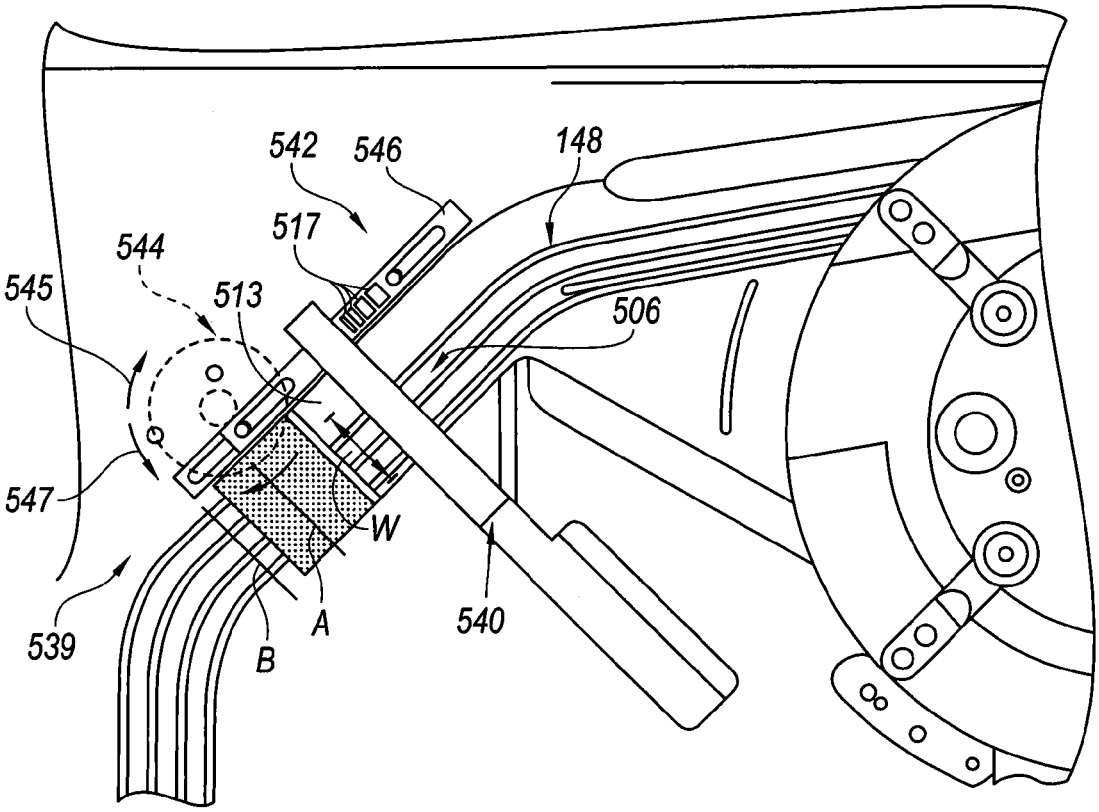
FIG. 5 is a front view of an auto-calibrating sensor assembly configured in accordance with another embodiment of the present disclosure.

FIG. 5 is a front view of an auto-calibrating sensor assembly 539 configured in accordance with another embodiment of the present disclosure. For ease of reference, the auto-calibrating sensor assembly 539 may alternatively be referred to herein as the sensor assembly 539. Similar to the auto-calibrating sensor assembly 139, the sensor assembly 539 includes a sensor 540 and a calibration unit 542 having a carrier 546 coupled to a driver 544. In the illustrated embodiment, the carrier 546 is in the shape of an elongate bar and, similar to the carrier 246, can be constructed from plastic or other non-magnetic and/or non-conductive materials. Additionally, in the illustrated embodiment, the driver 544 is an electric motor and the carrier 546 can be attached to the driver 544 via rack and pinion gearing (not shown). In other embodiments, the driver 544 can be a fluid controlled device, a solenoid, or another mechanical or electromechanical device. The sensor 540 extends past a width W of the rail 148. The carrier 546 is positioned alongside the rail 148 and is configured to travel through a gap 506 in the sensor 540 beside the path followed by coins travelling along the rail 148. A plurality of calibration objects 517 (e.g., calibrated test objects or coins) are carried by the carrier 546.

In operation, the carrier 546 is initially in position A, with calibration objects 517 on a first side 511 of the coin sensor 540. When the machine 100 initiates an automatic calibration of the coin sensor 540, the driver 544 rotates in a first direction 545 to rotate the pinion gear and drive the rack and the carrier 546 from position A to position B, translating or moving the calibration objects 517 through the gap 506 to a second side 513 of the coin sensor 540. Similar to the calibration described above with regard to FIG. 4, the coin sensor 540 generates signals associated with the calibration objects 517 and compares the signals to a calibration file to determine if an update to the calibration file is necessary. The driver 544 rotates in a second direction 547 opposite to the first direction 545 to move the carrier 546 from position B back to position A.

Figure 6:
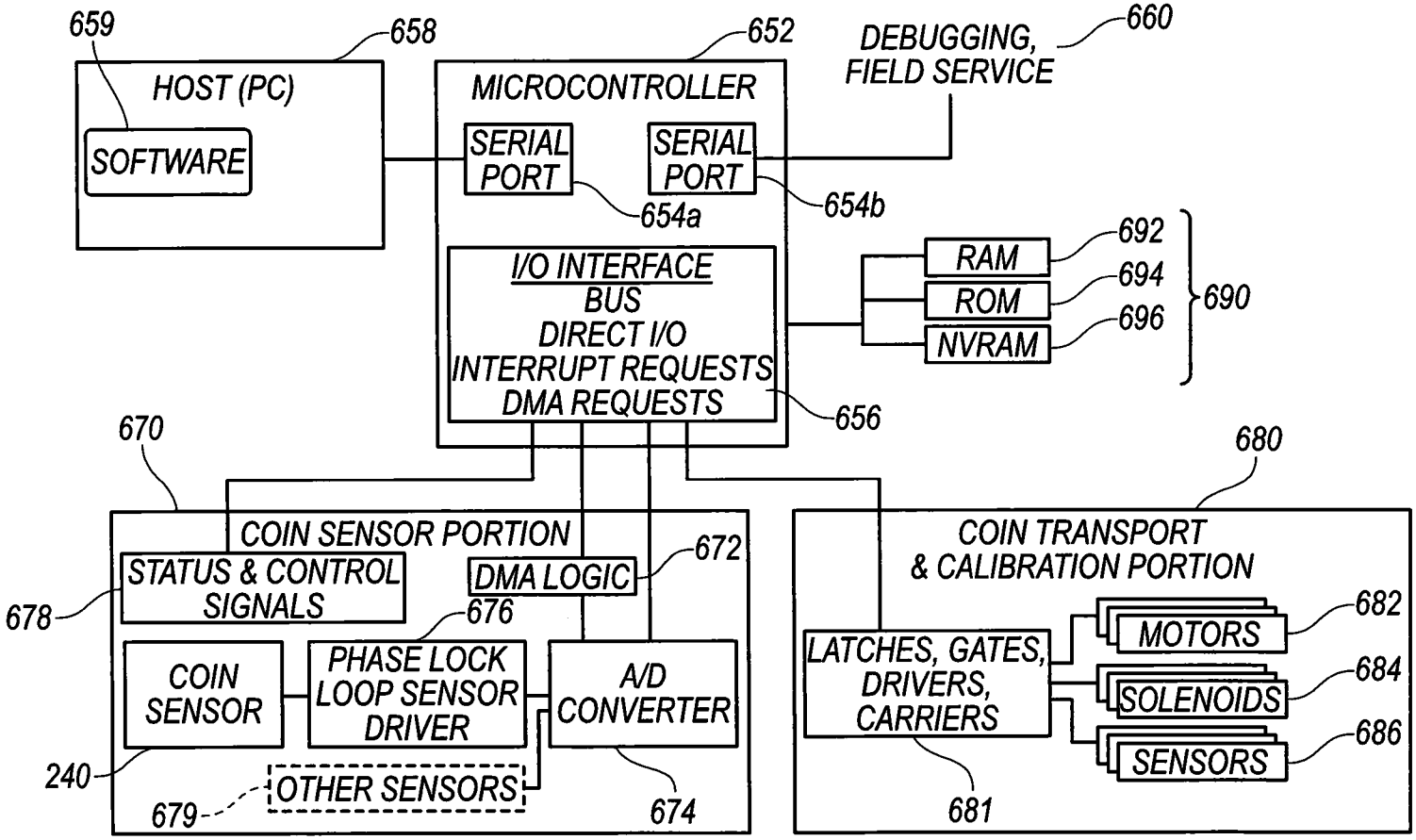
FIG. 6 is a schematic diagram of hardware and software for a coin counting machine configured in accordance with a further embodiment of the present disclosure.

FIG. 6 is a schematic block diagram of various hardware and software components configured to control the machine 100 in accordance with an embodiment of the present technology. Various combinations of electronic control circuits, controllers, motors, solenoids, sensors, converters, drivers, logic circuitry, input/output (I/O) interfaces, connectors or ports, personal computers (PCs), computer readable media, software, and other components can be included in or connected to the machine 100 to operate and control the coin counting portion 142 and other components. In the illustrated embodiment, for example, a controller or microcontroller 652 includes a first serial port 654*a*, a second serial port 654*b*, and an I/O interface bus 656. Although the illustrated embodiment includes serial ports 654, other embodiments may include USB ports, IEEE 1394 ports, Bluetooth transmitters/receivers, or other connection interfaces. The serial ports 654 can connect to additional components, such as a host computer, or PC 658 to install or update software 659, or can allow connections for operations such as field service or debugging 660. The I/O interface bus 656 is operably connected to a coin sensor portion 670, a coin transport and calibration portion 680, and a memory portion 690.

The coin sensor portion 670 can include direct memory access (DMA) logic 672, an analog-to-digital (ND) converter 674, a phase lock loop sensor driver 676, the coin sensor 240, status and control signals 678, and other sensors 679. The coin transport and calibration portion 680 can include latches, gates drivers and carriers 681 that can be driven, moved, or sensed by motors 682, solenoids 684 and sensors 686. Memory 690 can include random access memory (RAM) 692, read-only memory 694, and/or non-volatile random access memory (NVRAM) 696.

From the foregoing, it will be appreciated that specific embodiments have been described herein for purposes of illustration, but that various modifications may be made without deviating from the spirit and scope of the various embodiments of the disclosure. Hence, although certain embodiments of the present technology are described herein in the context of auto-calibrating coin sensors for use in coin counting machines, those of ordinary skill in the art will appreciate that the various structures and features of the auto-calibrating coin sensors described herein can also be utilized in a wide variety of other coin handling machines, including gaming devices (e.g., slot machines), vending machines, bus or subway "fare boxes," etc. Furthermore, it is within the scope of the present disclosure to provide other types of carriers or mechanisms to provide for an automatic calibration. For example, a carrier that is mounted on a pair of curved rails on each side of the coin rail can be utilized to bring calibration objects through the gap in the sensor. Additionally, other electrical, mechanical, or electromechanical devices can be employed in the auto-calibrating coin sensors of the present disclosure. A solenoid, for example, can be used to drive a carrier between a first and a second position.

Further, while various advantages and features associated with certain embodiments of the disclosure have been described above in the context of those embodiments, other embodiments may also exhibit such advantages and/or features, and not all embodiments need necessarily exhibit such advantages and/or features to fall within the scope of the disclosure. Accordingly, the disclosure is not limited, except as by the appended claims.

We claim:

1. A system for automatically calibrating a coin sensor in a coin counting machine, the system comprising:

at least one test object; and a carrier, wherein— the at least one test object is attached to the carrier, and the carrier is configured to automatically move the at least one test object from a first position spaced apart from the coin sensor to a second position proximate the coin sensor to calibrate the coin sensor.

2. The system of claim 1 wherein the carrier is further configured to rotate the at least one test object from the first position to the second position.

3. The system of claim 1 wherein the carrier is further configured to translate the at least one test object from the first position to the second position.

4. The system of claim 1 wherein the carrier is further configured to move the at least one test object from the first position to the second position in a linear path.

5. The system of claim 1 wherein the carrier is further configured to move the at least one test object along a path that is substantially similar to a portion of a path traveled by a coin deposited in the coin counting machine.

6. The system of claim 1 wherein the carrier is further configured to move the at least one test object through a gap in the coin sensor.

7. The system of claim 1 wherein the at least one test object comprises at least one calibration coin, and wherein the system further comprises a motor operably coupled to the carrier, wherein the motor is configured to rotate the carrier in a first direction, to move the at least one calibration coin from the first position to the second position, and wherein the motor is further configured to rotate the carrier in a second direction, opposite the first direction, to return the calibration coin from the second position to the first position.

8. The system of claim 1, further comprising:

a motor operably coupled to the carrier; and a controller operably coupled to the coin sensor and the motor, wherein— the controller is configured to send a first signal to the motor to move the carrier, and the controller is further configured to receive a second signal from the coin sensor, wherein the second signal comprises data generated as a result of the at least one test object being positioned proximate the coin sensor.

9. The system of claim 8, further comprising computer readable memory operably coupled to the controller, wherein the computer readable memory contains a calibration file, and wherein the controller is further configured to update the calibration file if the data from the second signal differs from a stored value by a predetermined amount.

10. The system of claim 1, further comprising:

a driver operably coupled to the carrier; and a controller operably coupled to the coin sensor and the driver, wherein the controller is configured to automatically move the test object from the first position to the second position to execute an automatic calibration cycle according to a preset time schedule.

11. The system of claim 1, further comprising:

a driver operably coupled to the carrier; and a controller operably coupled to the coin sensor and the driver, wherein the controller is configured to automatically move the test object from the first position to the second position to execute an automatic calibration cycle prior to counting a batch of coins submitted to the coin counting machine.

12. A coin counting machine comprising:

a coin sensor a test object movable from a first position spaced apart from the coin sensor to a second position proximate the coin sensor; and means for automatically moving the test object from the first position to the second position to calibrate the coin sensor.

13. The coin counting machine of claim 12 wherein the test object is fixedly attached to a carrier, and wherein the means for automatically moving the test object includes a controller that automatically initiates movement of the carrier according to a preset time schedule.

14. The coin counting machine of claim 12 wherein the test object is fixedly attached to a carrier, and wherein the means for automatically initiating movement of the test object includes a controller that automatically initiates movement of the carrier upon a detection of an ambient temperature change greater than a predetermined amount.

15. The coin counting machine of claim 12, further comprising a carrier, and wherein the test object is attached to the carrier.

16. The coin counting machine of claim 12 wherein movement of the test object from the first position to the second position includes movement in a radial path.

17. The coin counting machine of claim 16 wherein at least a portion of the radial path is substantially similar to a portion of a path traveled by a coin deposited in the coin counting machine.

18. A method for calibrating a coin sensor, the method comprising:

automatically moving at least one calibration object from a first position to a second position, wherein moving the at least one calibration object from the first position to the second position includes moving the at least one calibration object toward the coin sensor;

measuring an electronic output of the coin sensor in response to the calibration object being moved to the second position; and automatically moving the at least one calibration object from the second position back to the first position.

19. The method of claim 18 wherein automatically moving the at least one calibration object includes activating a driver, wherein the driver is operably coupled to a carrier, and wherein the at least one calibration object is fixedly attached to the carrier.

20. The method of claim 18 wherein the coin sensor is mounted in a coin counting machine, and wherein automatically moving the at least one calibration object includes automatically moving the at least one calibration object in response to a user depositing a batch of coins into the coin counting machine.

21. The method of claim 18 wherein automatically moving the least one calibration object includes automatically moving the at least one calibration object in response to an ambient temperature change greater than a predetermined value.

22. The method of claim 18 wherein measuring an electronic output of the coin sensor includes comparing an electronic output of the coin sensor to a stored value and updating the stored value if the output differs from the stored value by an amount greater than a predetermined amount.

23. The method of claim 18 wherein automatically moving the at least one calibration object from the first position to the second position Iincludes moving the at least one calibration object in a circular path.

24. The method of claim 18 wherein moving the at least one calibration object toward the second position includes moving the at least one calibration object through a gap defined by the coin sensor.

25. The method of claim 18 wherein automatically moving the at least one calibration object from the first position to the second position includes moving the at least one calibration object in a linear path.

* * * * *

UNITED STATES PATENT AND TRADEMARK OFFICE

CERTIFICATE OF CORRECTION

PATENT NO. : 9,003,861 B2
APPLICATION NO. : 13/269121
DATED : April 14, 2015
INVENTOR(S) : Douglas A. Martin et al.

It is certified that error appears in the above-identified patent and that said Letters Patent is hereby corrected as shown below:

In the claims

In column 8, line 30, in claim 12, delete “sensor” and insert -- sensor; --, therefor.

In column 10, line 8, in claim 23, delete “lincludes” and insert -- includes --, therefor.

Signed and Sealed this
Twenty-seventh Day of October, 2015

Michelle K. Lee

Michelle K. Lee
*Director of the United States Patent and Trademark Office*